US006371008B1

(12) United States Patent
Djelouah

(10) Patent No.: US 6,371,008 B1
(45) Date of Patent: Apr. 16, 2002

(54) WATER-RAISING PUMP

(75) Inventor: Salah Djelouah, Saint Denis de l'Hŏtel (FR)

(73) Assignee: Sorelec (FR)

( * ) Notice: Subject to any disclaimer, the term of this patent is extended or adjusted under 35 U.S.C. 154(b) by 0 days.

(21) Appl. No.: 09/540,724

(22) Filed: Mar. 31, 2000

(30) Foreign Application Priority Data

Mar. 31, 1999 (FR) ..... 99 04019
Dec. 15, 1999 (FR) ..... 99 15801

(51) Int. Cl.[7] ..... F01B 9/00; F16H 21/32; F16H 21/22

(52) U.S. Cl. ..... 92/140; 74/40; 74/44

(58) Field of Search ..... 74/51, 59, 40, 74/41, 42, 44; 92/140

(56) References Cited

U.S. PATENT DOCUMENTS 189,622 A * 4/1877 Gordon ..... 74/41
195,897 A * 10/1877 Laney ..... 74/40
309,155 A * 12/1884 Nagle ..... 74/44
1,051,347 A * 1/1913 Muller ..... 74/41
1,169,772 A * 2/1916 Chapman ..... 74/44
1,457,368 A * 6/1923 Huntting ..... 74/44
2,310,393 A * 2/1943 Carter ..... 74/41 X
2,392,921 A * 1/1946 Holman ..... 74/40
3,162,131 A * 12/1964 Clark ..... 74/40 X
4,207,774 A * 6/1980 Schwemin ..... 74/42
4,259,841 A * 4/1981 Thomas ..... 91/180 X

* cited by examiner

*Primary Examiner*—John E. Ryznic
(74) *Attorney, Agent, or Firm*—Baker & Daniels

(57) ABSTRACT

Water-raising pump for drawing water in a ground water table, which pump comprises a tube connecting the surface to the water table to be pumped, a rod carrying the pistons, which is connected to a drive mechanism installed at the surface for imparting to the rod a reciprocating pumping motion. The mechanism comprises:

two identical toothed wheels (7, 8), mounted on axes (72, 82) that are symmetrical relative to the trajectory (ZZ) of the rod (3) carrying the pistons, meshing in each other so as to rotate in opposite directions, a motive unit (9, 10, 11) connected to at least one of the wheels (7) to drive it in rotation, two identical connecting rods (12, 13) each connected to the head (14) of the rod (3) and to a point of articulation borne by each toothed wheel (71, 81), in symmetrical positions, in order to be driven in symmetrical motions relative to the trajectory (ZZ) of the rod (3) in order to guide and drive the rod and its pistons.

3 Claims, 5 Drawing Sheets

WATER-RAISING PUMP

The present invention concerns a water-raising pump for drawing water in a ground water table, which pump comprises a tube connecting the surface to the water table to be pumped, a rod carrying the pistons, which is connected to a drive mechanism installed at the surface for imparting to the rod a reciprocating pumping motion.

In general, such pumps are intended to be installed in places benefiting from little technical assistance, and must also be as simple and robust as possible. However, one of the great difficulties in the driving of water-raising pumps is the guiding of the rod carrying the pistons. The guiding must be as centred as possible relative to the draft tube in order to reduce friction to a minimum and thus facilitate the operation of the pump while reducing the wear.

In this type of pump it is likewise necessary to reduce to their simplest form the guide means necessary for the rod, since these guide means, at least those which are on the outside, close to the drive source, are exposed to dust, sand, etc. which reduce or indeed impair the guiding characteristics. This in turn has its effect on the correct operation of the installation and its reliability.

The aim of the present invention is to remedy some of the drawbacks of the known water-raising pumps, and proposes to provide a drive and guiding means which is as simple as possible, subject to little wear even in very difficult operating conditions such as in an atmosphere charged with sand or dust, and which allows very regular and smooth driving of the pumping rod.

To this end, the invention concerns a water-raising pump of the type defined above, characterized in that the mechanism comprises:

- two identical toothed wheels, mounted on axes that are symmetrical relative to the trajectory of the rod carrying the pistons,
- meshing in each other so as to rotate in opposite directions, a motive unit connected to at least one of the wheels to drive it in rotation,
- two identical connecting rods, each connected to the head of the rod and to a point of articulation borne by each toothed wheel, in symmetrical positions, in order to be driven in symmetrical motions relative to the trajectory of the rod in order to guide and drive the rod and its pistons.

The symmetrical arrangement of the drive means according to a symmetry relative to the axis of the rod makes it possible to ensure the guiding of the pump rod in the plane of symmetry and to maintain the head of the pump necessarily in this plane of symmetry.

The drive device is extremely simple and, once adjusted, it can no longer lose its adjustment, at least with regard to the geometry of the trajectory of the rod.

Moreover, owing to the simplicity of the means employed, the mechanical output is very high, since friction is reduced to a minimum.

The stroke of the rod is adjusted by means of the lever arm of the point of articulation of one end of each connecting rod relative to the centre of rotation of the toothed wheels.

Such a pump can be driven by a crank, manually, or by a motor, especially an electric motor fed by a solar cell or by a generating set in the case of an electric motor.

According to other advantageous features of the invention:

- one of the toothed wheels includes or constitutes the inertia flywheel,
- the connecting member between the two connecting rod big ends and the head of the rod receives the articulations of the rod head and the two articulations or fixing points of the two connecting rods,
- the connecting rods can operate in pull or in push mode.

Finally, the connection with the drive device is a belt or a chain.

According to other advantageous features of the invention:

- the connecting rods are connected to the rod by way of levers pivotally mounted on pivots,
- the connecting rods are connected to the toothed wheels by way of levers mounted on pivots co-operating with the toothed wheels through a connection with rollers and slides, the slides being provided in the levers and the rollers in the form of pivots carried by the toothed wheels.

Finally, such a machine, used as a pump driven by a motor, may also operate as a motor supplied with pressurized fluid.

The present invention will be described hereinafter in more detail with reference to the appended drawings, in which.

Figure 2:
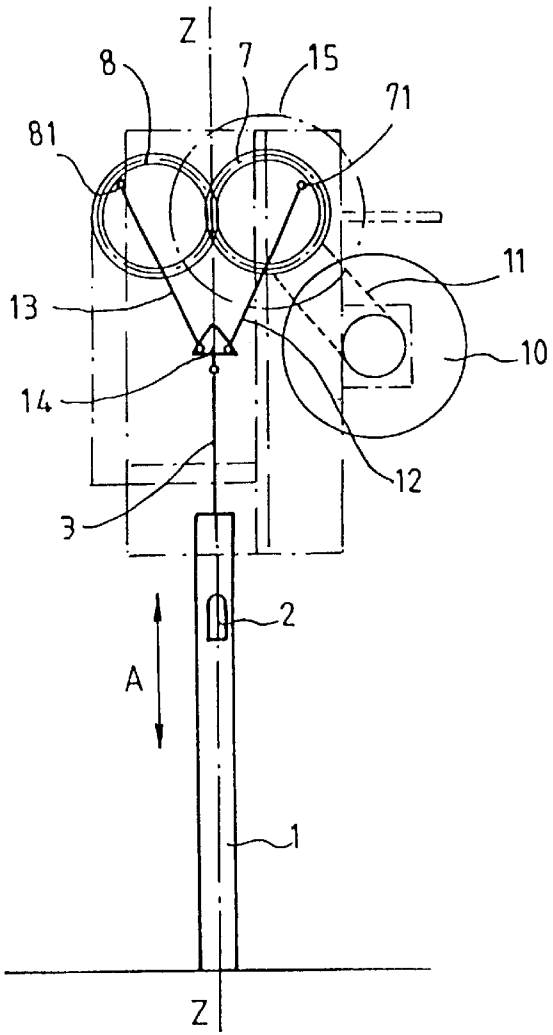
FIG. 2 is a front view of the pump in FIG. 1.
Figure 1:
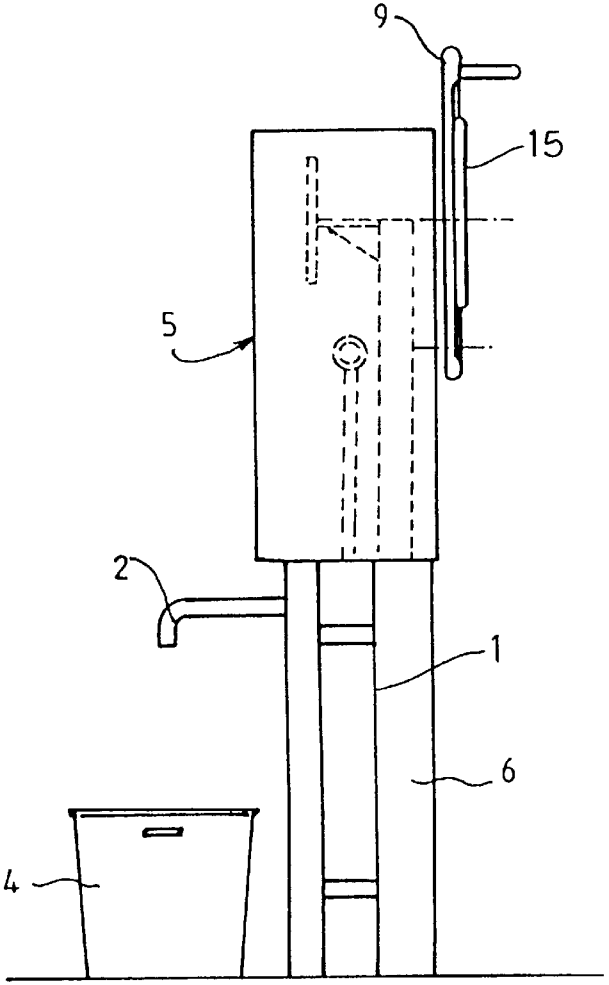
FIG. 1 is a side view of the water-raising pump according to the invention, the rod with the pistons and the draft tube being shown only partially.

According to FIGS. 1 and 2, the invention concerns a water-raising pump comprising a tube 1, provided with an outlet spout 2 to deliver the water pumped in a ground water table. The draft tube 1 receives a rod 3 carrying pistons, not shown. The rod 3 executes a reciprocating motion (double arrow A) to descend into the water table and raises, by degrees, a certain amount of water which will flow out through the spout 2 into a receptacle 4.

The rod 3 is driven by a mechanism housed in a housing 5 mounted on a support 6. The housing 5 houses two identical toothed wheels 7, 8, mounted rotatably in symmetrical positions relative to the direction ZZ of the trajectory of the rod 3. The two toothed wheels 7, 8 mesh with each other so as to turn in the opposite direction of rotation.

The rotation of the two toothed wheels 7, 8 is effected by a motive unit consisting either of a flywheel with crank 9 (FIG. 1) or of a motor 10 connected to one of the wheels by a belt 11 (FIG. 2).

Two identical connecting rods 12, 13 connect the head of the rod 3, by way of articulations carried by a connecting member 14, to points of articulation borne by the toothed wheels 7, 8. These points of articulation 71, 81 occupy symmetrical positions relative to the direction ZZ of the trajectory of the rod 3 when the wheels 7, 8 are meshed.

The connecting rods 12, 13 are driven by the wheels 7, 8, in a symmetrical motion relative to the direction ZZ. This motion manifests itself as a translational reciprocating motion of the rod 3, that is to say, a pumping motion.

FIG. 1 shows the variant of the pump with a wheel with crank 9, and FIG. 2 shows the variant with a motor 10 and a belt 11. In both cases, there is an inertia flywheel 15 to stabilize the rotational movement. The flywheel does not appear in FIG. 1.

In the case of FIG. 2, the inertia flywheel 15 is carried by the wheel 7 or by the axis rigidly connected to the wheel.

In the embodiments of FIGS. 1 and 2, the head of the rod 3 is hooked to the two connecting rods 12, 13 which act in traction, the opposing force being the weight of the rod 3, of the pistons and of the pumped water.

Figure 3:
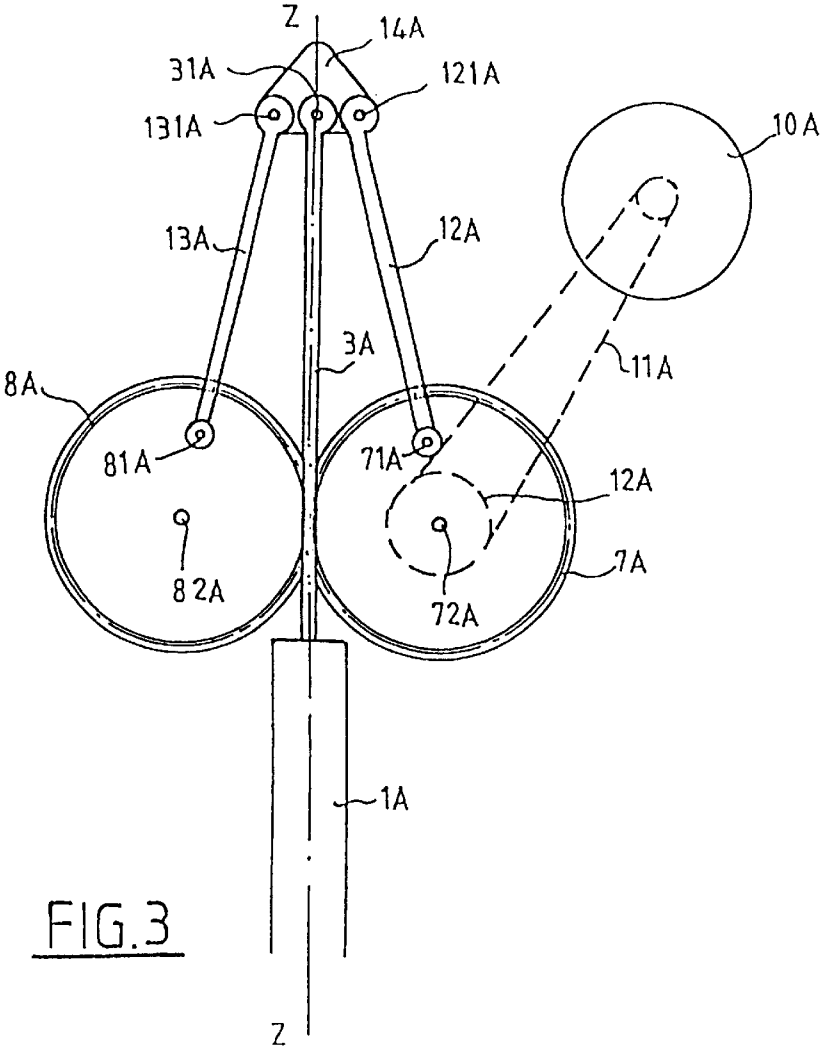
FIG. 3 is a diagrammatic view of an embodiment of a drive mechanism for the rod of a water-raising pump.
Figure 5:
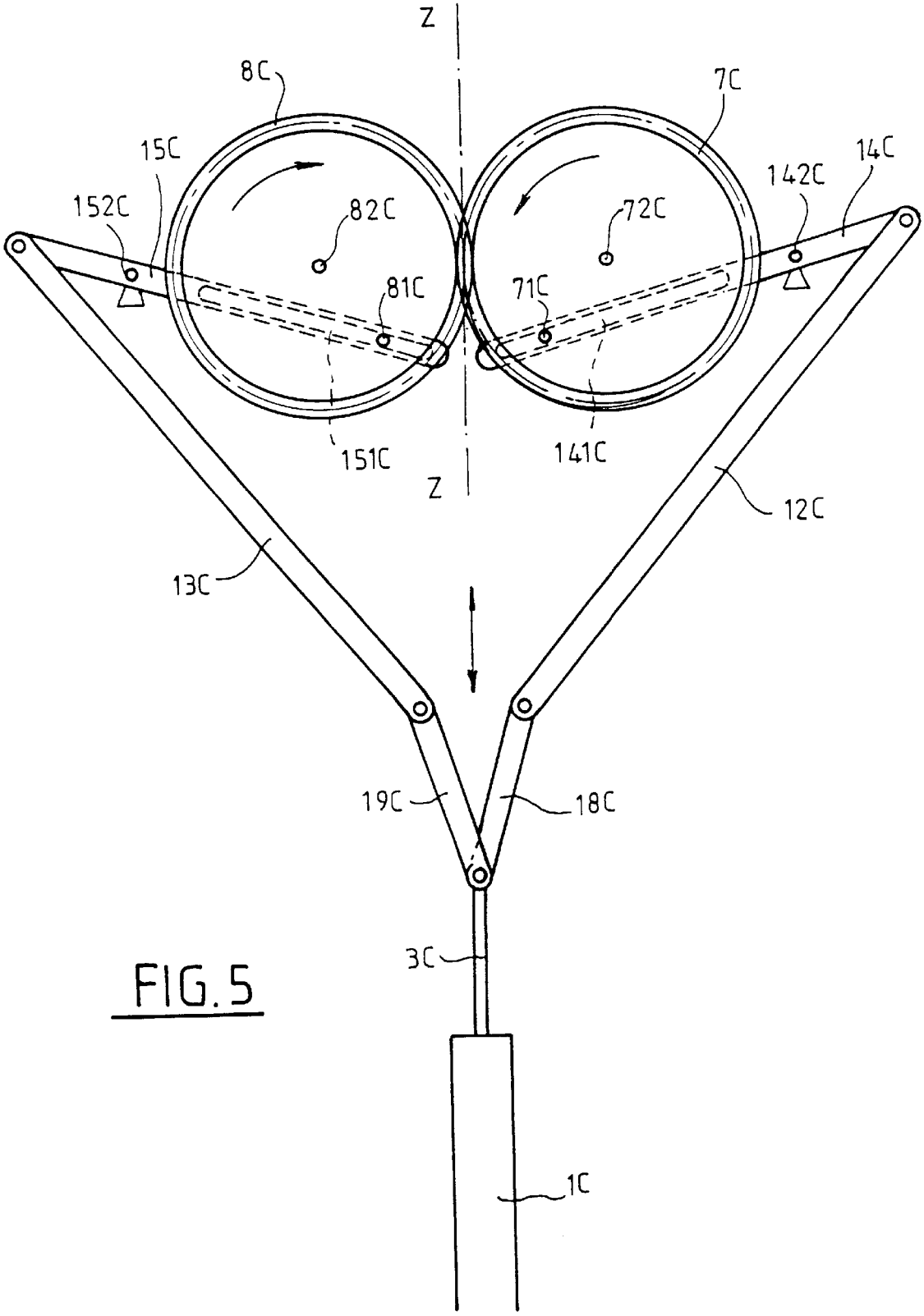
FIG. 5 is a diagrammatic view of a third variant of the mechanism according to the invention.

FIG. 3 shows a variant of embodiment in which the toothed wheels 7A, 8A mesh as before and are identical, being mounted symmetrically on two axes 72A, 82A symmetrical relative to the plane ZZ passing through the rod 3A of the water-raising pump, the tube of which bears the reference 1A.

This figure shows the connecting member 14A on which are articulated the heads 121A, 131A of the connecting rods 12A, 13A and the head 31A of the rod 3A.

In the variant in FIG. 3, the connecting rods 12A, 13A do not pull the rod 3A but push it, the wheels 7A, 8A and the connecting rods 12A, 13A being placed below the head 14A carried by the connecting rod 3A. This drive is also effected by a motor 10A transmitting its motion through a belt or a chain 11A passing over a pulley 12A which is simply sketched.

The points of articulation 71A, 81A of the connecting rods 12A, 13A are adjustable in the radial direction of the toothed wheels 7A, 8A, which makes it possible to modify the length of the stroke imparted to the head 14A and therefore to the rod 3A.

Figure 4:
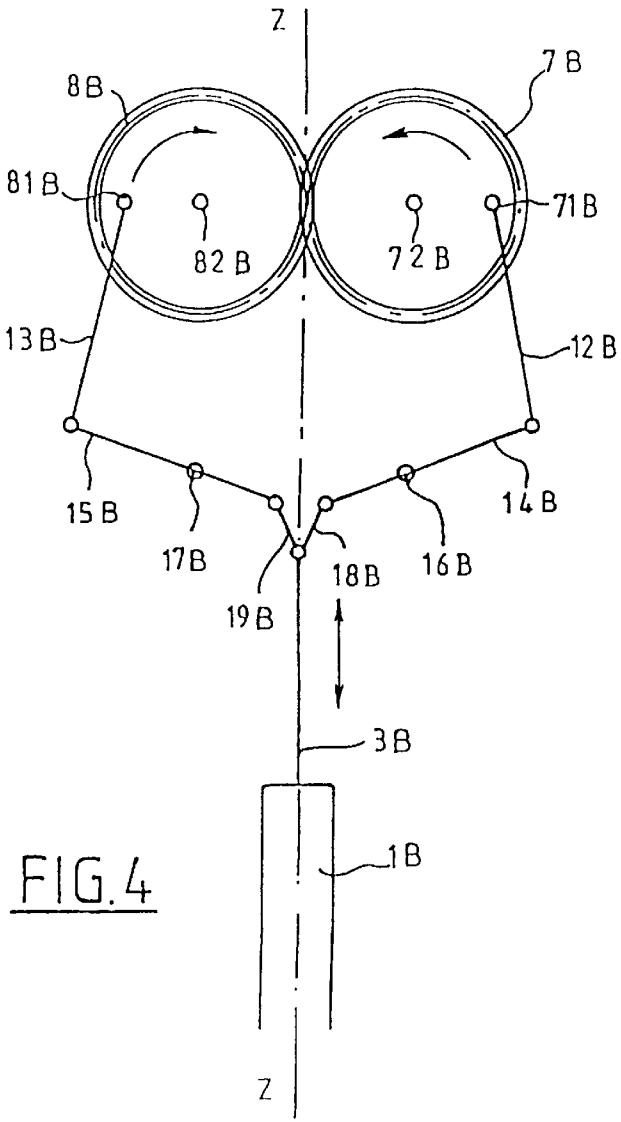
FIG. 4 is a diagrammatic view of a second variant of the invention.

According to FIG. 4, the drive mechanism for the rod 3B of the draft tube 1B consists of two identical toothed wheels 7B, 8B mounted on axes 72B, 82B that are symmetrical relative to the trajectory ZZ of the rod 3B. The two toothed wheels 7B, 8B mesh so as to turn in opposite directions. The drive means such as the crank carried by a flywheel associated with one of the toothed wheels, or a motor with a chain or belt transmission, is not shown.

The mechanism comprises transmission means symmetrical as far as the rod 3B. Thus, the transmission of the motion is effected by two connecting rods 12B, 13B, articulated at 71B and 81B in positions symmetrical to the toothed wheels 7B, 8B. The connecting rods 12B, 13B are each connected by an articulation, not provided with a reference, to a lever 14B, 15B mounted about a respective pivot 16B, 17B. The other end of the levers 14B, 15B is connected in an articulated manner by a rocker bar 18B, 19B to the rod 3B.

The rocker bars 18B, 19B are necessary to compensate for the circular motion of the end of the levers 14B, 15B carrying the articulation. The rocker bars 18B, 19B could also be replaced by a connecting member such as the connecting members 14, 14A above, in which there would be slides for the articulation of the ends of the levers 14B, 15B.

The reciprocating motion of the rod 3B is represented by a double arrow.

The third variant of the invention, for the drive mechanism of the rod 3C in the draft tube 1C, consists of two toothed wheels 7C, 8C, which are identical and mounted on axes 72C, 82C symmetrical relative to the plane ZZ of displacement of the rod 3C. The identical toothed wheels mesh so as to rotate in opposite directions. The toothed wheels are driven by a drive means such as a crank carried by a flywheel, or a motor with a belt or chain connection, not shown.

The transmission of the motion to the rod 3C is effected by means symmetrical relative to the plane ZZ. These means consist of a connecting rod 12C, 13C connected to the rod 3C by rocker bars 18C, 19C or by a connecting member such as the members 14, 14A described above. The connecting rods 12C, 13C are connected to the toothed wheels 7C, 8C by levers 14C, 15C, one end of which is articulated on the corresponding end of each connecting rod 12C, 13C and the other end of which is connected by way of a slide 141C, 151C to a pivot 71C, 81C rigidly connected to each of the toothed wheels 7C, 8C. The pivots 71C, 81C are carried in fixed, symmetrical positions on the two toothed wheels. The pivots 71C, 81C constitute rollers sliding relatively in the slides 141C, 151C when the toothed wheels 7C, 8C rotate to impart an alternating pivoting motion to the levers 14C, 15C. These levers themselves pivot on pivots 142C, 152C.

The upward and downward movement of the rod 3C is indicated diagrammatically by a double arrow.

Figure 6:
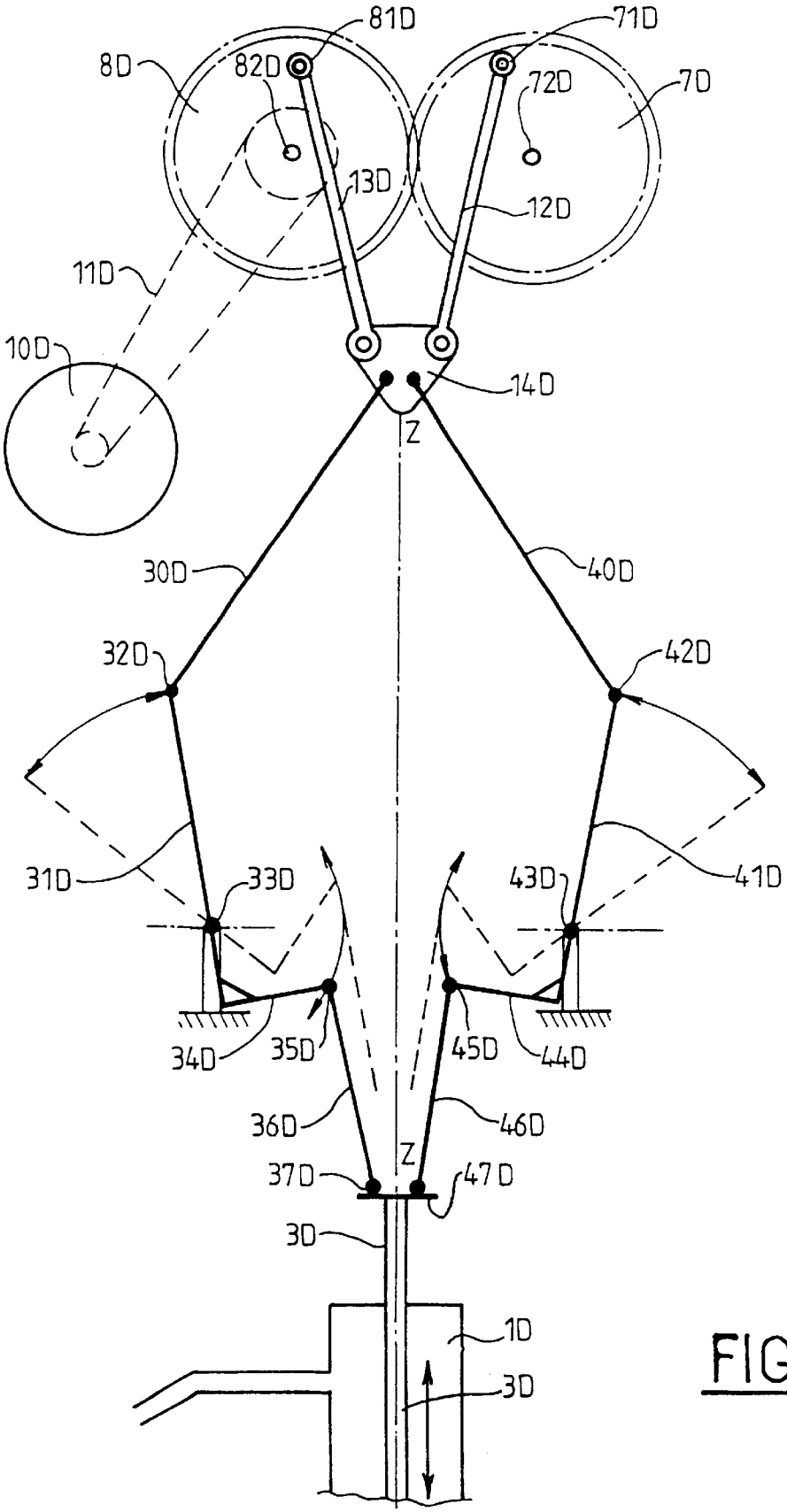
FIG. 6 shows a fourth variant of embodiment of the invention.

According to FIG. 6, a fourth embodiment of the invention will be described hereinafter. The parts common to the embodiment of the preceding figures will bear the same references with the addition of the letter D and their detailed description will not be repeated.

In this embodiment, the member 14D to which are connected the connecting rods 12D, 13D driven for example by way of the belt 11D from the motor 10D, is fixed to two symmetrical connecting rod and lever assemblies.

This transmission assembly connecting the plate 14D to the rod 3D consists, in the left hand part of the figure, of a connecting rod 30D articulated on the plate 14D and on an elbow lever of the first kind with two arms 31D, 34D which are mounted about a fixed pivot 33D.

The arm 31D passing through the pivot 33D is connected square, to the arm 31D beyond the pivot 33D.

The arm 31D is articulated on the connecting rod 30D by way of the articulation 32D and the arm 34D is connected to a connecting rod 36D by way of an articulation 35D. The connecting rod 36D is connected by the articulation 37D to the rod 3D.

The symmetrical part of this system of connecting rods and lever bears the same references as the part described above, increased by 10. Thus, this part consists of a first connecting rod 40D connected to the plate 14D and by an articulation 42D to a lever of the first kind with two arms 41D, 44D, the first arm 41D of which passes through the pivot 43D. The second arm 44D is connected by an articulation 45D to a connecting rod 46D which is itself articulated by the articulation 47D) on the rod 3D).

Under the effect of the reciprocating motion of the plate 14D, the symmetrical connecting rods and lever move as indicated by the motions of the articulations 32D, 35D; 42D, 45D according to the double arrows.

This reducing mechanism makes it possible to adjust the upward and downward stroke of the rod 3D in response to the power supplied by the motor 10D and the data of the installation, in particular the rate of flow.

Figure 7:
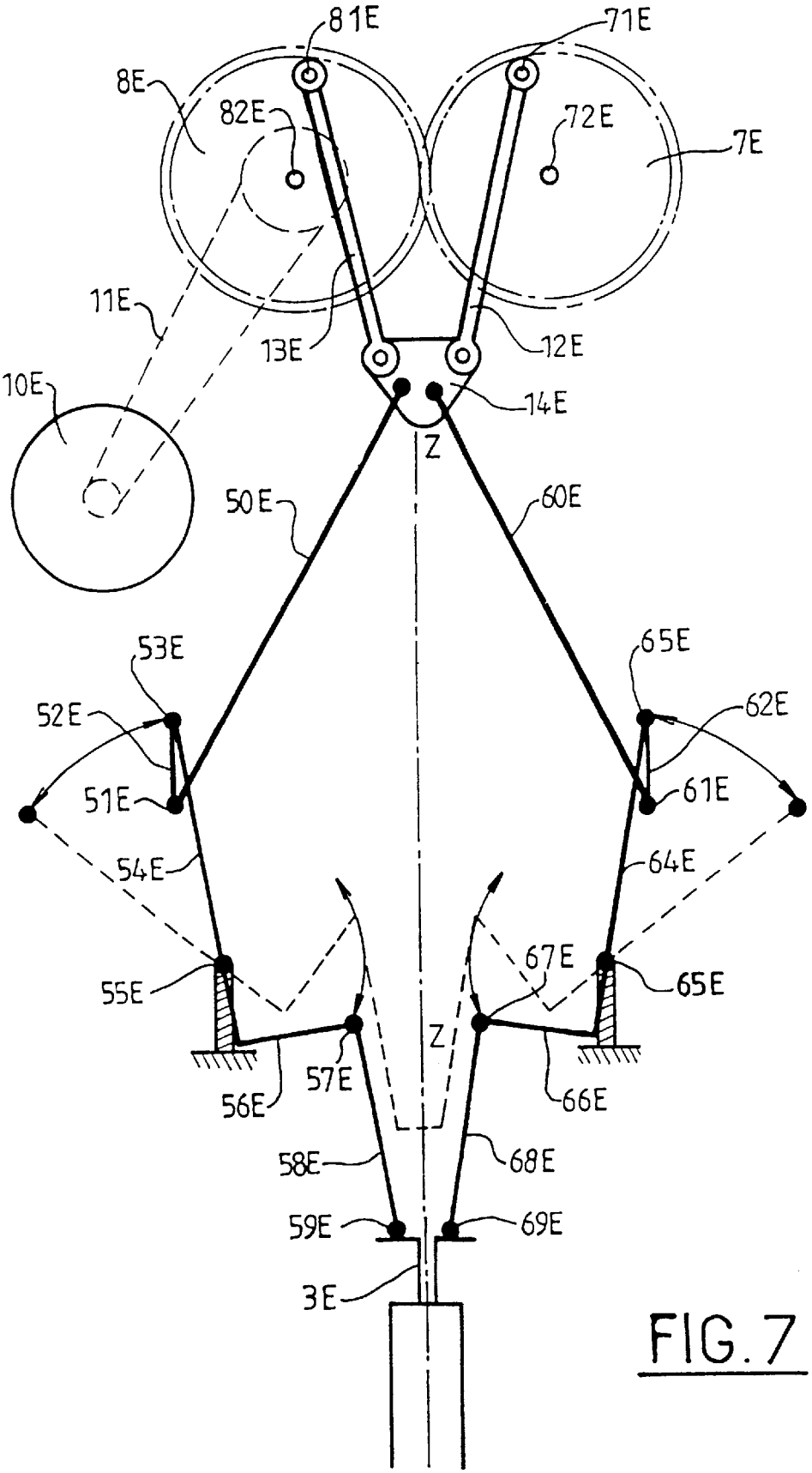
FIG. 7 shows a fifth variant of embodiment of the invention.

According to FIG. 7, the fifth variant of embodiment of the invention also includes parts common to the preceding embodiments. For these common parts, the same references will be used, with the addition of the suffix E.

In this variant, the plate 14E is connected to the rod 3E likewise by two lever and connecting rod assemblies, symmetrical relative to the axis ZZ. The assembly on the left consists of a connecting rod 50E articulated on the plate 14E and connected (51E) to a rocker bar 52E itself articulated (53E) on a lever with two arms 54E, 56F, the first arm 54E of which is mounted on the pivot 55E, the second arm 56E being perpendicular to the extension of the first arm 56E beyond the pivot 55E. The second arm is connected by an articulation 57E to a connecting rod 58E itself connected to the rod 3E by an articulation 59E.

The other assembly of symmetrical connecting rods and lever consists of a connecting rod 60E connected by an articulation 61E to a rocker bar 62E, itself connected by an articulation 63E to an arm 64E of a lever with two arms 64E, 66E. The first arm is pivotally mounted on the pivot 65E and the second arm 66E is connected by the articulation 67E to a connecting rod 68E itself connected by an articulation 69E to the rod 3E. This mechanism with connecting rod and rocker bar also allows great flexibility of adjustment of the strokes and the operation of the pump.

What is claimed is:

1. A pump for drawing water from an underground water source to the earth's surface, said pump comprising:

a tube;

at least one piston operatively associated with said tube to draw water from a said source;

a rod operatively supporting said piston, said rod having one rod end, said rod reciprocatingly movable along an axis of movement;

two connecting rods, each said rod having a first connecting rod end and a second connecting rod end, each said connecting rod having a first said connecting rod end connected to said one rod end;

two toothed rotatable wheels, each said wheels having a center, each said wheel mounted on a respective axis, said axes symmetrically located relative to said axis of movement, said wheels rotatably engaging each other for rotation in respective opposite directions;

two rollers, each said roller mounted at a respective mounting point on a respective said wheel, said mounting points respectively equidistantly spaced from said respective centers of said respective wheels;

two levers, each said lever having a first and a second lever end, each said lever having a first said respective lever end respectively connected to a respective said second connecting rod end, each said respective lever slidably connected to a said respective roller, each said lever pivotally mounted on respective pivot points which are located intermediate said respective first and second lever ends; and means for drivingly rotating said wheels.

2. A pump for drawing water from an underground water source to the earth's surface, said pump comprising:

a tube;

at least one piston operatively associated with said tube to draw water from a said source;

a rod operatively supporting said piston, said rod having one rod end, said rod reciprocatingly movable along an axis of movement;

two toothed rotatable wheels, each said wheels having a center, each said wheel mounted on a respective axis, said axes symmetrically located relative to said axis of movement, said wheels rotatably engaging each other for rotation in respective opposite directions;

a connecting plate;

two levers, each said lever having a first and second lever end, each said levers having a first said respective lever end respectively connected to a respective connecting point on a respective said wheel, said connecting points respectively equidistantly spaced from said respective centers of said respective wheels, each said lever having a respective said second lever end connected to said connecting plate;

two articulated elongated linkages, each said linkage having at least three elongated members, said members each having two member ends, said members interconnected at their respective member ends to define said respective linkages, said linkages each having a first linkage end and a second linkage end, said first linkage ends connected to said connecting plate, said second linkage ends connected to said tube, said linkages symmetrically arranged on opposite sides of said axis of movement;

means for drivingly rotating said wheels.

3. The pump according to claim 2 wherein each said linkage includes a rocker bar and an elbow lever.

* * * * *